US006820448B1

(12) United States Patent
Hsieh

(10) Patent No.: US 6,820,448 B1
(45) Date of Patent: Nov. 23, 2004

(54) BIKE AND MOTORCYCLE PADLOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 0 days.

(21) Appl. No.: 10/816,755

(22) Filed: Mar. 30, 2004

(51) Int. Cl.[7] ..... E05B 73/00
(52) U.S. Cl. ..... 70/18; 70/233
(58) Field of Search ..... 70/14, 18, 19, 70/30, 49, 233

(56) References Cited

U.S. PATENT DOCUMENTS 557,522 A * 3/1896 Blake ..... 70/43
589,861 A * 9/1897 Schroeder ..... 70/236
3,747,376 A * 7/1973 White, Jr. ..... 70/18
3,748,876 A * 7/1973 Mathews ..... 70/18
3,959,995 A * 6/1976 Fletcher ..... 70/18
4,760,718 A * 8/1988 Muramatsu et al. ..... 70/18
4,986,095 A * 1/1991 Chou et al. ..... 70/10
5,018,374 A * 5/1991 Montano ..... 70/233
5,076,531 A * 12/1991 Delaney ..... 248/552
5,406,811 A * 4/1995 Nakai ..... 70/26
5,475,993 A * 12/1995 Kuo ..... 70/18
5,487,285 A * 1/1996 Leichel et al. ..... 70/18
5,678,435 A * 10/1997 Hodson ..... 70/233
5,694,797 A * 12/1997 Kuo ..... 70/53
5,732,577 A * 3/1998 Okada et al. ..... 70/18
5,913,906 A * 6/1999 Strocchi ..... 70/18
6,012,739 A * 1/2000 Weiss et al. ..... 280/814

* cited by examiner

*Primary Examiner*—Suzanne Dino Barrett

(57) ABSTRACT

A bike and motorcycle padlock includes a lock core rod, at least one connecting rod and a lock rod pivotally connected together. The lock core rod has one end provided with a locking hole, while the locking rod has its free end provided with a locking member to be inserted in the locking hole of the lock core rod. The lock core rod, the connecting rod and the locking rod are pivotally connected together to make up the bike and motorcycle padlock by means of connecting members, able to be expanded for use quickly and collapsed for storing conveniently.

1 Claim, 6 Drawing Sheets

BIKE AND MOTORCYCLE PADLOCK

BACKGROUND OF THE INVENTION

1. Field of the Invention

This invention relates to a bike and motorcycle padlock, particularly to one consisting of a lock core rod, at least one connecting rod and a locking rod pivotally connected together, able to be collapsed for storing conveniently and expanded for use quickly.

2. Description of the Prior Art

A conventional bike and motorcycle padlock 1, as shown in FIG. 1, includes a shackle 11 and a lock cylinder 12 combined together. The U-shaped locking rod 11 has one end formed with a locking member 110 to be inserted in the lock core hole 120 of the lock cylinder 12 to lock the bike and motorcycle padlock 1. To unlock the padlock 1, a key is inserted in the keyhole to turn the lock core for releasing the locking member 110 of the shackle 11 and then remove the padlock 1 away from the bike.

Although convenient to be locked to a bike for prevention of burglary, the conventional bike and motorcycle padlock having the shackle 11 and the lock cylinder 12 formed integral cannot be collapsed, requiring a large space for storing the shackle padlock.

SUMMARY OF THE INVENTION

The objective of the invention is to offer a bike and motorcycle padlock able to be collapsed for storing conveniently and expanded for use quickly.

The feature of the invention is a lock core rod having one end provided with a locking hole and the other end formed with two pivotal lugs, at least one connecting rod having its opposite ends respectively provided with one and two pivotal lugs extending sideward and having one end pivotally connected with the lock core rod by a connecting member, and a locking rod having one end provided with a pivotal lug to be pivotally connected with the connecting rod by a connecting member and the other end formed with a locking member to be inserted in the locking hole of the lock core rod.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
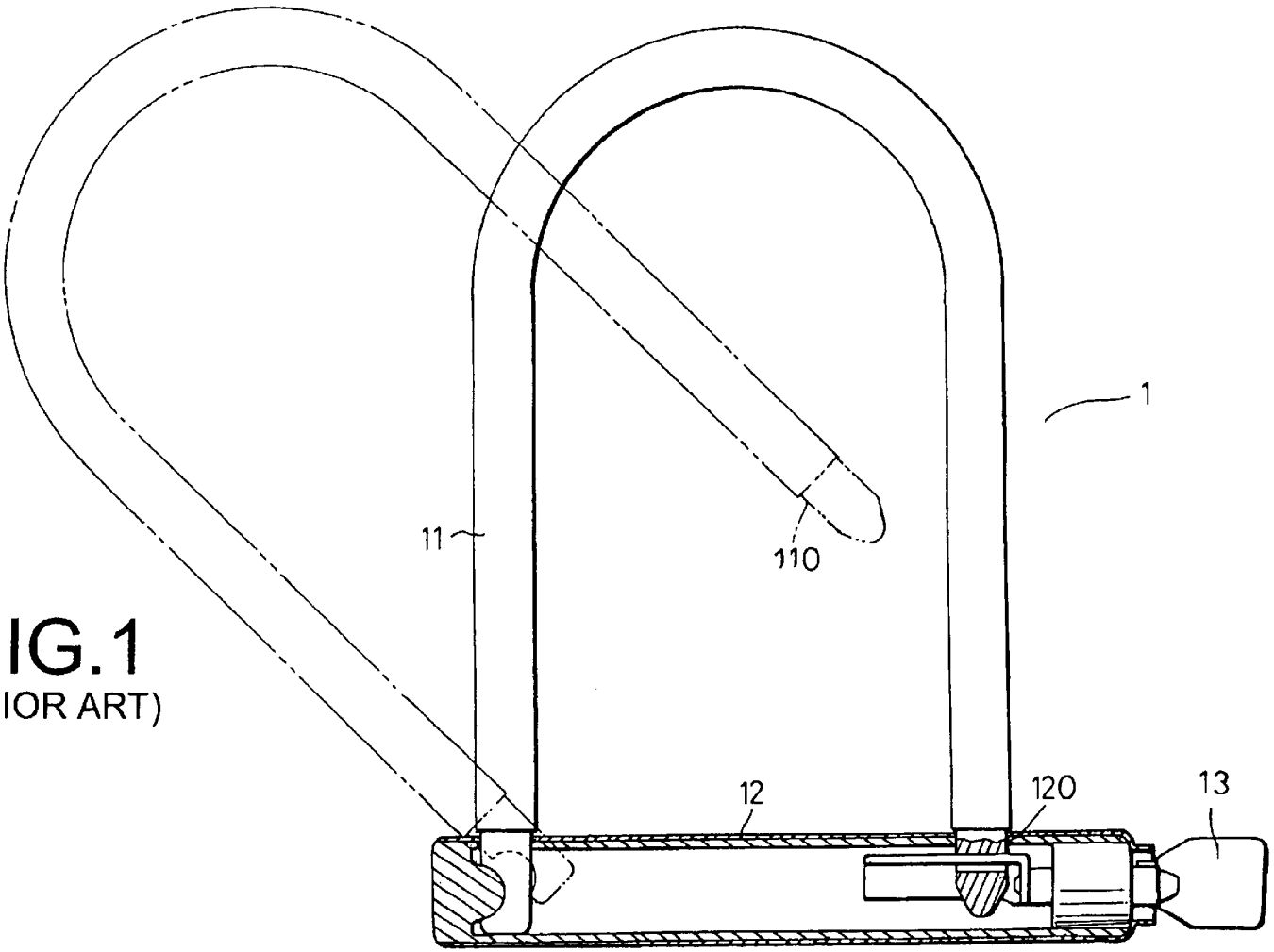
FIG.1 (PRIOR ART)
FIG. 1 is a cross-sectional view of a conventional bike and motorcycle padlock.
Figure 2:
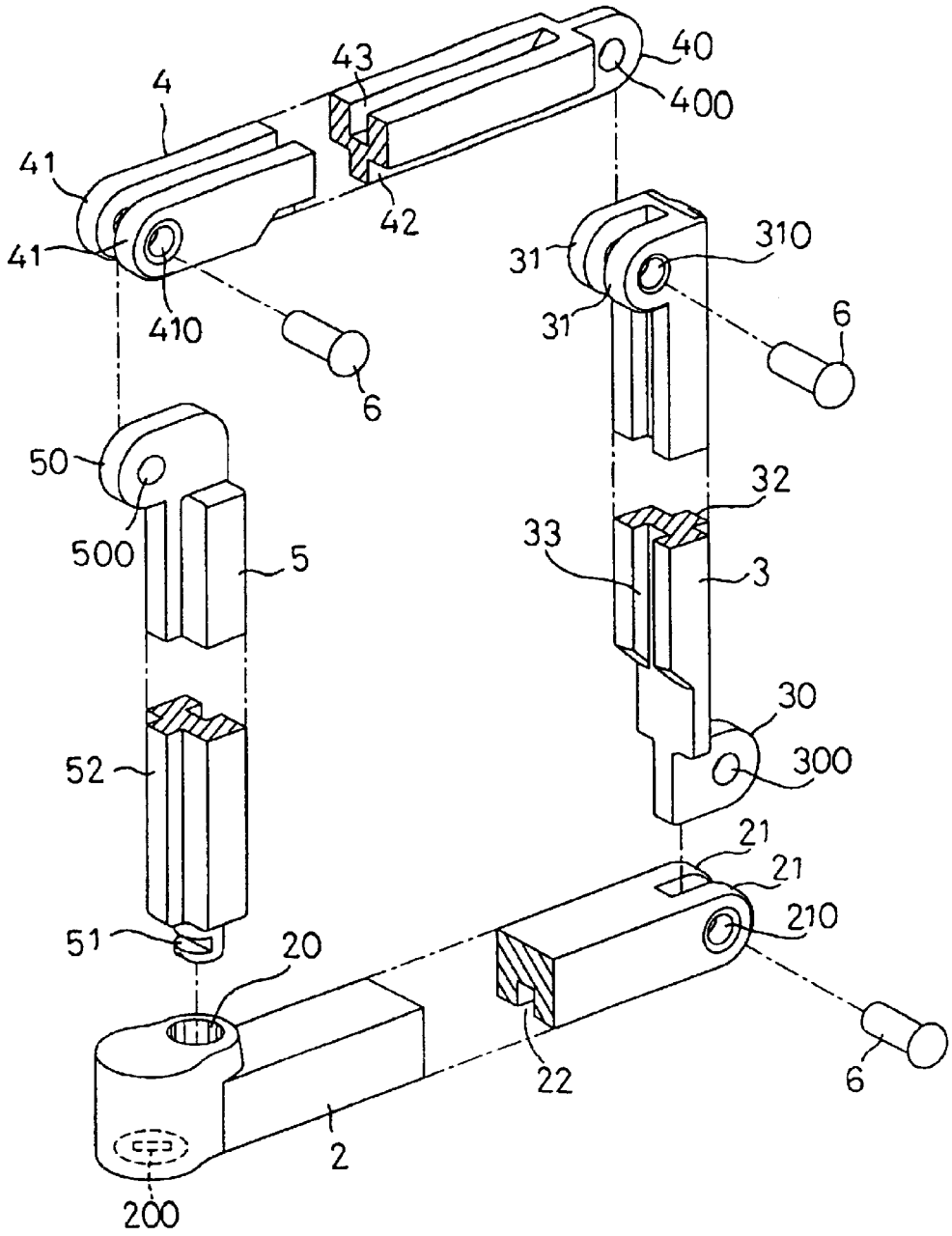
FIG. 2 is an exploded perspective view of a bike and motorcycle padlock in the present invention.
Figure 3:
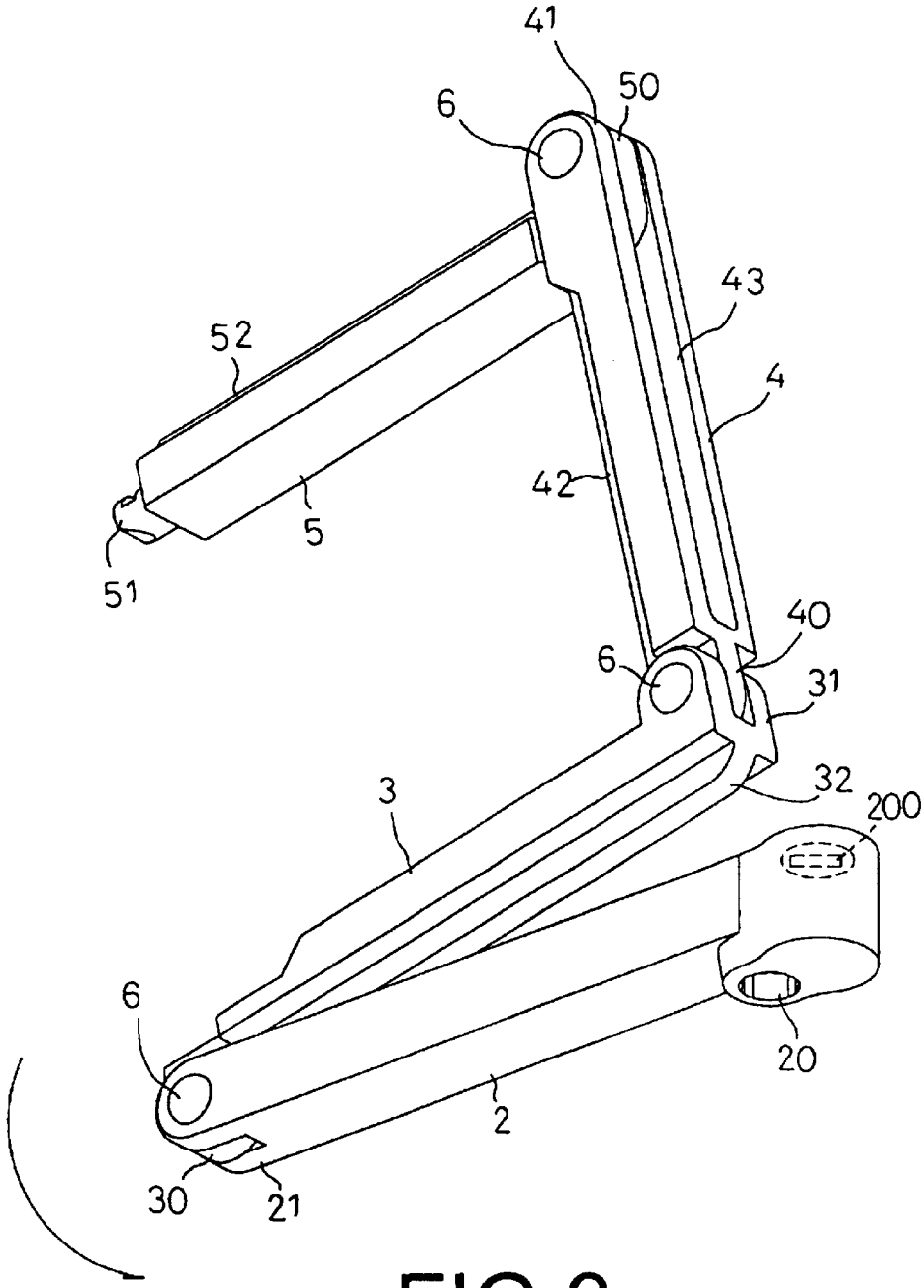
FIG. 3 is a perspective view of the bike and motorcycle padlock having its lock core rod collapsed counterclockwise in the present invention.
Figure 4:
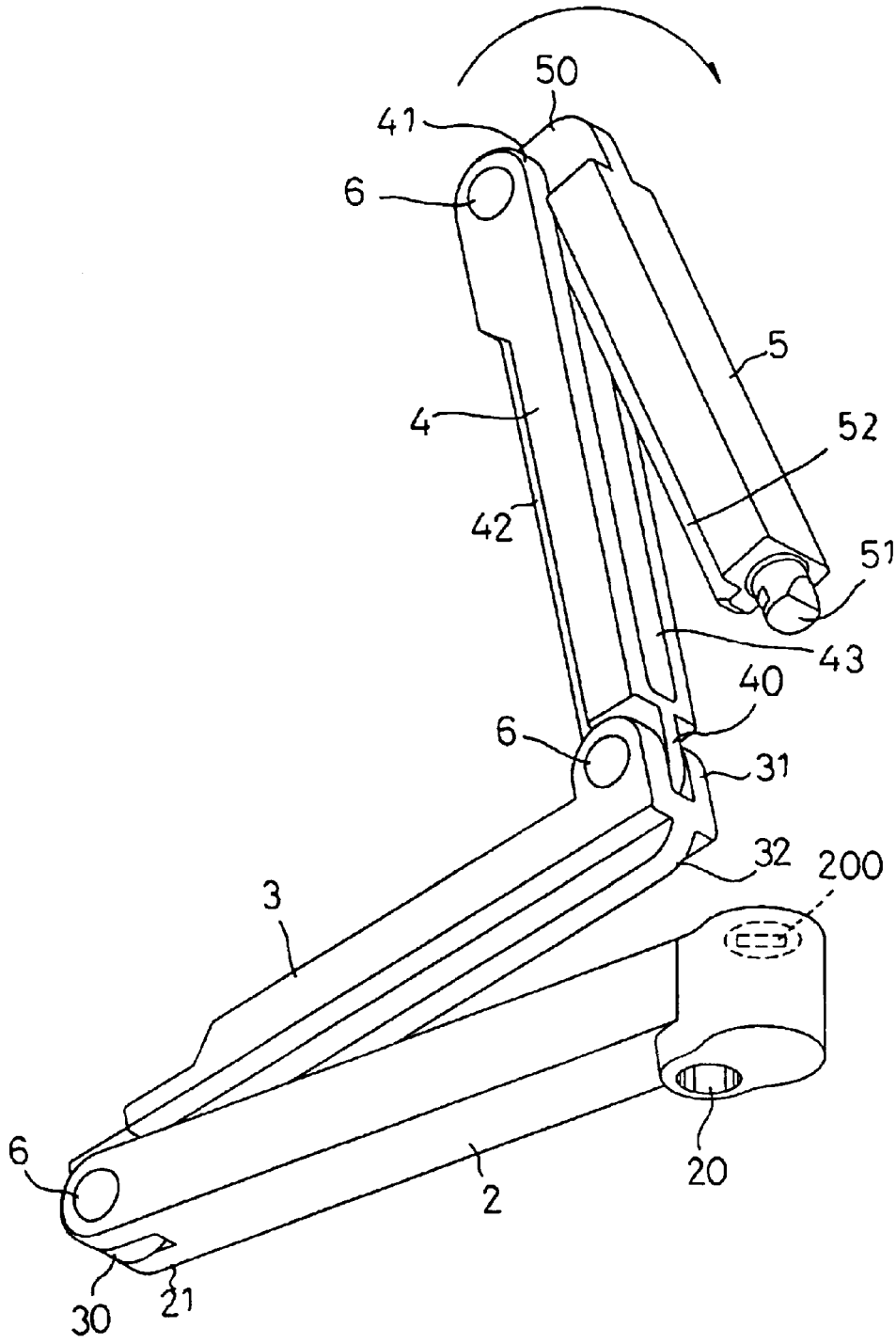
FIG. 4 is a perspective view of the bike and motorcycle padlock in a first collapsed condition in the present invention.
Figure 5:
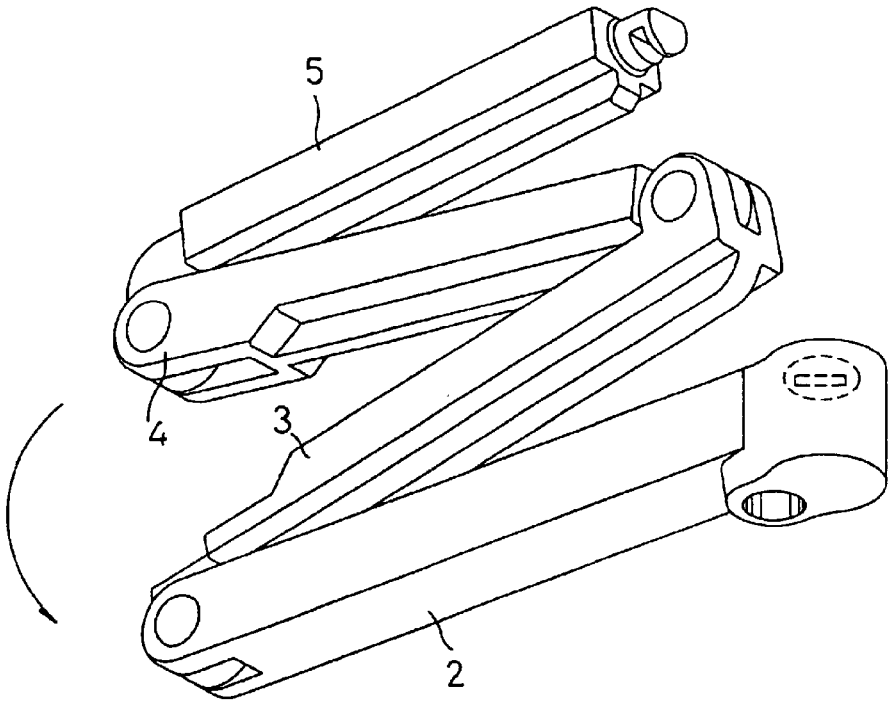
FIG. 5 is a perspective view of the bike and motorcycle padlock in a second collapsed condition in the present invention; and, FIG. 6 is a perspective view of the bike and motorcycle padlock collapsed in the present invention.

A preferred embodiment of a bike and motorcycle padlock in the present invention, as shown in FIGS. 2, 3 and 4, includes a lock core rod 2, a first connecting rod 3, a second connecting rod 4 and a locking rod 5 combined together.

The lock core rod 2 has one end bored with a locking hole 20 and a keyhole 200 in the opposite side of the locking hole 20 and the other end provided with two pivotal lugs 21 extending forward and respectively having an insert hole 210. The lock core rod 2 further has its outer side formed with a lengthwise recessed groove 22.

The first connecting rod 3 to be pivotally connected with the lock core rod 2 by a connecting member 6 has one end provided with a pivotal lug 30 extending outward and having an insert hole 300 to be pivotally connected with the pivotal lug 21 of the lock core rod 2, and the other end provided with two pivotal lugs 31 extending inward and respectively having an insert hole 310. Further, the first connecting rod 3 has its outer side provided with lengthwise elongate projection 32 to be engaged with the lengthwise recessed groove 22 of the lock core rod 2, and its inner side formed with a lengthwise recessed groove 33.

The second connecting rod 4 to be pivotally connected with the first connecting rod 3 by a connecting member 6 has one end provided with a pivotal lug 40 extending forward and having an insert hole 400 to be pivotally connected with the two pivotal lugs 31 of the first connecting rod 3, and the other end provided with two pivotal lugs 41 extending forward and respectively having an insert hole 410. The second connecting rod 4 further has one side provided with a lengthwise elongate projection 42 to be engaged with the lengthwise recessed groove 33 of the first connecting rod 3, and the other side bored with a lengthwise recessed groove 43 opposite to the lengthwise elongate projection 42.

The locking rod 5 to be pivotally connected with the second connecting rod 4 by a connecting member 6 has one end provided with a pivotal lug 50 extending outward and having an insert hole 500 to be pivotally connected with the two pivotal lugs 41 of the second connecting lug 4, and the other end provided with a protruding-out locking member 51 to be locked in the locking hole 20 of the lock core rod 2. The locking rod 5 has its outer side formed with a lengthwise elongate projection 52 to be engaged with the lengthwise recessed groove 43 of the second connecting rod 4.

In assembling, firstly, the first connecting rod 3 is positioned to have one side with the elongate projection 32 facing outside, and the lock core rod 2 to have one side with the recessed groove 22 facing outside. Then the pivotal lug 30 of the first connecting rod 3 is inserted in between the two pivotal lugs 21 of the lock core rod 2, letting the insert hole 300 of the pivotal lug 30 aligned to the two insert holes 210 of the two pivotal lugs 21. Then, the connecting member 6 is inserted through the insert holes 300, 210 to pivotally connect the first connecting rod 3 with the lock core rod 2.

Next, the second connecting rod 4 has its recessed groove 43 facing outside and the outer end of its pivotal lug 40 inserted in between the two pivotal lugs 31 of the first connecting rod 3. Then the connecting member 6 is inserted through the insert holes 310 and 400 of the pivotal lugs 31 and 40 to pivotally connect together the first connecting rod 3 and the second connecting rod 4. Lastly, the locking rod 5 has its elongate projection 52 facing upward and the outer end of its pivotal lug 50 inserted in between the two pivotal lugs 41 of the second connecting rod 4 and then the connecting member 6 is inserted through the insert holes 410 and 500 to pivotally connect the second connecting rod 4 with the locking rod 5 together to finish assembly of the bike and motorcycle padlock.

In using, only expand the shackle padlock to make the locking rod 5 pass through the wheel of a bike or a motorcycle and the locking member 51 at the end of the locking rod 5 inserted in the locking hole 20 of the lock core rod 2 to finish locking.

Figure 6:
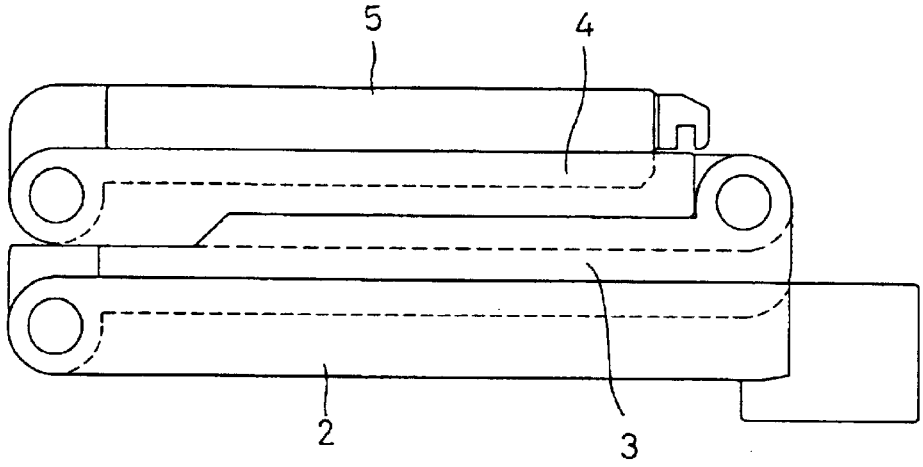

To collapse the bike and motorcycle padlock after unlocking, as shown in FIGS. 3 to 6, firstly, the lock core rod 2 is pivotally collapsed counterclockwise and the clocking rod 5 is pivotally collapsed clockwise to let the elongate projection 32 of the first connecting rod 3 engaged in the recessed groove 22 of the lock core rod 2, and the elongate projection 52 of the locking rod 5 engaged in the recessed groove 43 of the second connecting rod 4. Then, the first and the second connecting rod 3 and 4 are collapsed toward each other to let the elongate projection 42 of the second connecting rod 4 engaged in the recessed groove 33 of the first connecting rod 3 to finish collapsing of the bile and motorcycle padlock, as shown in FIG. 6.

While the preferred embodiment of the invention has been described above, it will be recognized and understood that various modifications may be made therein and the appended claims are intended to cover all such modifications that may fall within the spirit and scope of the invention.

What is claimed is:

1. A bike and motorcycle padlock comprising:

a lock core rod having one end provided with a locking hole, said lock core rod having the other end provided with two pivotal lugs extending forward;

at least one connecting rod having one end pivotally connected with said lock core rod by a connecting member, said connecting rod having its opposite ends respectively provided with one and two pivotal lugs;

a locking rod having one end pivotally connected with said connecting rod by a connecting member, said locking rod having one end provided with a pivotal lug and the other end provided with a locking member, said locking member able to be inserted in said locking hole of said lock core rod; and, said connecting members serving as pivots to enable said lock core rod and said locking rod and connecting rod to be collapsed so as to diminish the volume of said bike and motorcycle padlock and save space in storing;

wherein said lock core rod has one side provide with a lengthwise recessed groove, and said connecting rod has one side provided with an elongate projection matching with said recessed groove of said lock core rod and the other side formed with a lengthwise recessed groove, and said locking rod has one side provided with an elongate projection matching with said recessed groove of said connecting rod.

* * * * *